US009518411B2

(12) United States Patent
Dery et al.

(10) Patent No.: US 9,518,411 B2
(45) Date of Patent: Dec. 13, 2016

(54) MORTISE DOOR LOCK SYSTEM

(71) Applicant: FERCO FERRURES DE BATIMENT INC, Laval (CA)

(72) Inventors: Sabin Dery, Laval (CA); Marcel Van Der Hoeven, Burlington (CA); Jan Huml, Medford, WI (US)

(73) Assignee: FERCO FERRURES DE BATIMENT INC., Laval (CA)

( * ) Notice: Subject to any disclaimer, the term of this patent is extended or adjusted under 35 U.S.C. 154(b) by 361 days.

(21) Appl. No.: 13/786,839

(22) Filed: Mar. 6, 2013

(65) Prior Publication Data

US 2013/0234449 A1 Sep. 12, 2013

Related U.S. Application Data

(60) Provisional application No. 61/607,068, filed on Mar. 6, 2012.

(51) Int. Cl.

| | |
|---|---|
| ***E05C 1/06*** | (2006.01) |
| ***E05C 7/04*** | (2006.01) |
| ***E05C 1/08*** | (2006.01) |
| ***E05C 9/04*** | (2006.01) |
| ***E05B 63/06*** | (2006.01) |
| *E05C 9/10* | (2006.01) |

(52) U.S. Cl.

CPC ..... *E05C 7/04* (2013.01); *E05B 63/06* (2013.01); *E05C 1/065* (2013.01); *E05C 1/08* (2013.01); *E05C 7/045* (2013.01); *E05C 9/042* (2013.01); *Y10T 292/0968* (2015.04); *Y10T 292/1022* (2015.04)

(58) Field of Classification Search

CPC ..... E05C 7/00; E05C 7/04; E05C 7/05; E05C 7/045; E05C 1/00; E05C 1/004;E05C 1/006; E05C 1/08; E05C 1/12; E05C 1/14; E05C 1/145; E05C 9/00; E05C 9/008; E05C 9/02; E05C 9/025; E05C 9/04; E05C 9/042; E05C 9/10; E05C 9/14; E05C 1/02; E05C 1/06; E05C 1/065; E05B 63/06

USPC ..... 292/32, 34–36, 40, 137, 163, 165–167,292/173, 139, 143, DIG. 15, DIG. 21, DIG. 31,292/DIG. 60

See application file for complete search history.

(56) References Cited

U.S. PATENT DOCUMENTS

| | | | | |
|---|---|---|---|---|
| 1,561,018 A | | 11/1925 | Peelle | |
| 1,895,630 A | * | 1/1933 | Kemp | 70/118 |
| 2,610,368 A | | 9/1952 | Tschaepe | |
| 2,736,185 A | * | 2/1956 | Collar | 70/100 |

(Continued)

FOREIGN PATENT DOCUMENTS

| | | | |
|---|---|---|---|
| EP | 2772603 A2 | * | 9/2014 |
| FR | 2607177 A1 | * | 5/1988 |
| WO | WO 2010109070 A1 | * | 9/2010 |

*Primary Examiner* — Alyson M Merlino

(74) *Attorney, Agent, or Firm* — Cantor Colburn LLP

(57) ABSTRACT

A lock system for a door comprises one or more elongated members adapted to translate axially in a door to be moved in and out of engagement into a lock catch of a door frame. A lock mechanism is received in a mortise of the door and having a handle actuatable to displace at least one driver in translation. A depth adjustment adaptor comprises a interface connected to the elongated member, with or without a joint with at least one degree of freedom connecting the interface to the driver to adjust a depth of the interface relative to the driver and to a lateral surface of the door to actuate the axial translation of the elongated member by movement of the driver.

20 Claims, 4 Drawing Sheets

(56) References Cited

U.S. PATENT DOCUMENTS

| | | | | | |
|---|---|---|---|---|---|
| 3,437,363 | A | * | 4/1969 | Walters | 292/113 |
| 3,888,046 | A | | 6/1975 | Meisterheim | |
| 3,943,882 | A | * | 3/1976 | Sollak et al. | 116/303 |
| 4,009,537 | A | | 3/1977 | Hubbard | |
| 4,601,499 | A | * | 7/1986 | Kim | 292/36 |
| 4,881,765 | A | * | 11/1989 | Heid | 292/92 |
| 5,154,454 | A | * | 10/1992 | Hollaway | 292/21 |
| 5,290,077 | A | | 3/1994 | Fleming | |
| 5,350,207 | A | | 9/1994 | Sanders | |
| 5,382,060 | A | * | 1/1995 | O'Toole et al. | 292/46 |
| 5,688,000 | A | * | 11/1997 | Dolman | 292/34 |
| 5,906,403 | A | * | 5/1999 | Bestler et al. | E05B 65/087 292/117 |
| 6,491,326 | B1 | | 12/2002 | Massey et al. | |
| 6,725,602 | B1 | | 4/2004 | McWilliams | |
| 6,796,603 | B2 | * | 9/2004 | Pringnitz | 296/186.3 |
| 6,883,837 | B1 | | 4/2005 | Lin | |
| 7,000,959 | B2 | | 2/2006 | Sanders | |
| 7,201,408 | B2 | * | 4/2007 | Cennamo, Jr. | 292/143 |
| 7,735,882 | B2 | | 6/2010 | Abdollahzadeh et al. | |
| 2010/0212375 | A1 | * | 8/2010 | Mitchell et al. | 70/141 |
| 2012/0001443 | A1 | | 1/2012 | Mitchell | |

* cited by examiner

MORTISE DOOR LOCK SYSTEM

CROSS-REFERENCE TO RELATED APPLICATION

The present application claims priority on U.S. patent application Ser. No. 61/607,068.

FIELD OF THE APPLICATION

The present application relates to a lock system of the type lodged in a mortise of a door, such as a door of French doors.

BACKGROUND OF THE ART

Pairs of doors, such as French doors, are commonly found in homes and buildings. Indeed, a pair of doors may be opened to define a larger frame opening. In the case of such doors, one of the doors is semi-permanently closed, while the other door is the utility door that is primarily used to enter/exit through the door frame.

The semi-permanently closed door typically features a lock system that is lodged in a mortise defined in a lateral surface of the door. In some cases, an astragal may seal off the gap between adjacent doors. The astragal is conventionally secured to the semi-permanently closed door and may form part of the mortise. Such mortise lock systems have at least one rod that projects beyond a top or bottom end surface of the door in a lock hole of the door frame. Therefore, the mortise lock system must be interfaced to the rod to actuate its displacement.

However, the distance of the rod from the lateral surface of the door may vary as a function of the door manufacturer, the presence or absence of an astragal, the configuration of the mortise, etc. As a result, inventories of mortise lock systems configured for various depths must be kept to accommodate different depths of mortises.

SUMMARY OF THE APPLICATION

It is therefore an aim of the present disclosure to provide a mortise lock system that addresses issues associated with the prior art.

It is a further aim of the present disclosure to provide a more keys lock system comprising a depth adjustment mechanism.

Therefore, in accordance with the present application, there is provided a lock system for a door comprising: at least one elongated member adapted to translate axially in a door to be moved in and out of engagement into a lock hole of a door frame; a lock mechanism adapted to be received in a mortise of the door and having a handle actuatable to displace at least one driver in translation; and a depth adjustment adaptor comprising a interface connected to the elongated member, and a joint with at least one degree of freedom connecting the interface to the driver to adjust a depth of the interface relative to the driver and to a lateral surface of the door to actuate the axial translation of the elongated member by movement of the driver.

Further in accordance with the present application, there is provided an assembly of a door and lock system comprising: a door comprising the mortise open to a lateral surface thereof, and at least one channel extending from the mortise to an end surface of the door; a lock system comprising: at least one elongated member received in the at least one channel of the door and translatable axially therein to be moved beyond the end surface of the door and in and out of engagement into a lock hole of a door frame, a lock mechanism received in a mortise of the door and having a handle actuatable to displace at least one driver in translation, and a depth adjustment adaptor comprising a interface connected to the elongated member, and a joint with at least one degree of freedom connecting the interface to the driver to adjust a depth of the interface relative to the driver and to the lateral surface of the door to actuate the axial translation of the elongated member in the channel by movement of the driver.

DETAILED DESCRIPTION

Figure 1:
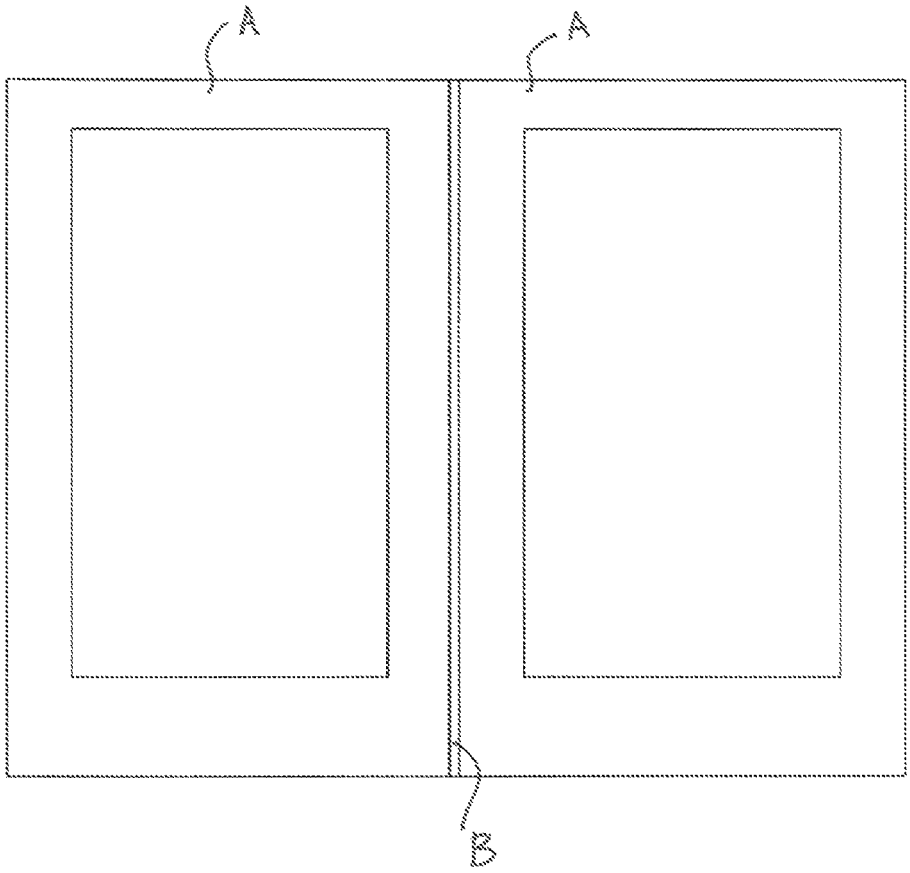
Fig. 1 (PRIOR ART)
FIG. 1 is front elevational view of a pair of doors with an astragal therebetween in accordance with the prior art.

Referring to the drawings and, more particularly, to FIG. 1, a pair of doors are schematically illustrated at A. The doors may also be known as French doors, with one of the doors being semi-permanently closed while the other door is the utility door that is used. The door that is semi-permanently closed may be opened to increase the size of the entrance, for instance, to provide sufficient room for large objects to be fitted through the door frame. An astragal B may be secured to the semi-permanently closed door and is used to seal off the gap between the doors A. Accordingly, the astragal B may be considered a part of the semi-permanently closed door.

Figure 2:
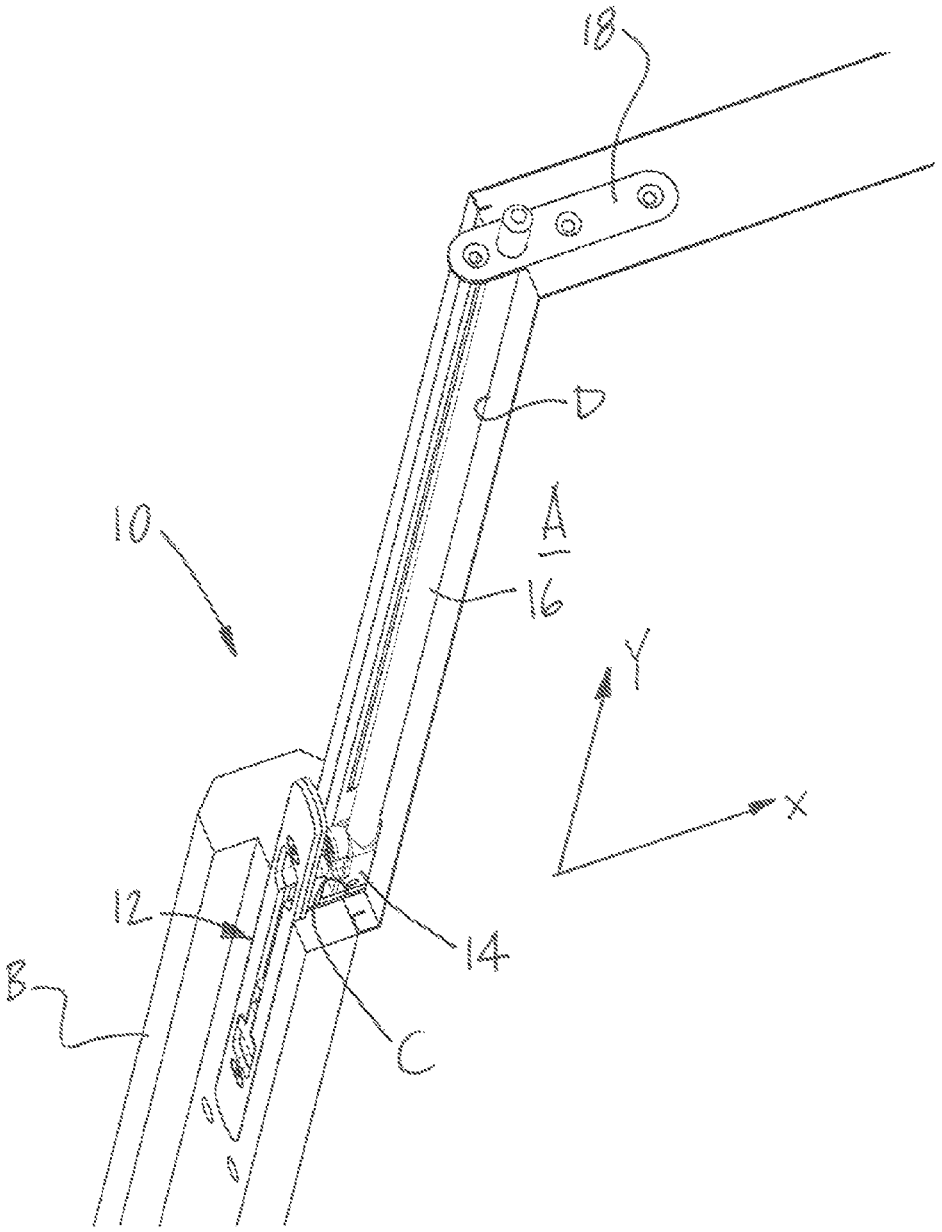
FIG. 2 is a perspective view, fragmented, of a lock system in accordance with an embodiment of the present disclosure.

As shown in FIG. 2, the astragal B may have a T-shaped horizontal section. A lock system is generally shown at 10 and is partially located in a mortise C defined concurrently into the astragal B and the door A. The mortise C is also known as a cavity, receptacle, etc. At least one channel D (partially shown in FIG. 2) is in communication with the mortise C and is generally vertical in door A. The channel D extends to the top edge surface in FIG. 2, and another channel may extend from the mortise C to the bottom edge surface of the door A, as an alternative or in addition to the channel D shown in FIG. 2.

The lock system 10 comprises a lock mechanism 12, a depth adjustment adaptor 14 and at least one elongated member, such as a rod 16. An end plate 18 may be provided for each rod 16.

The lock mechanism 12 is located in the mortise C and is used to actuate the vertical movement of the rod or rods 16 into the channel D.

The depth adjustment adaptor 14 interfaces the lock mechanism 12 to the rod 16, as a function of the depth of the mortise C.

The rod 16 is the locking element of the lock system 10 and moves in a vertical axial direction as a function of the actuation of the lock mechanism 12. A free end of the rod 16 engages into a lock hole of the door frame to keep the door A in a closed and locked position. The door may have two rods 16, with the rods 16 moving concurrently in opposite directions as a result of an actuation of the lock mechanism 12. In the illustrated embodiment, the rod 16 has a circular section. It is considered to use rods of different sections, and flat bars as well.

The end plate 18 is used to guide the rod 16 into properly engaging with the lock hole in the door frame. Moreover, the end plate 18 provides structural integrity to the edge surface of the door A at the region at which the rod 16 projects out of the door A.

Figure 3:
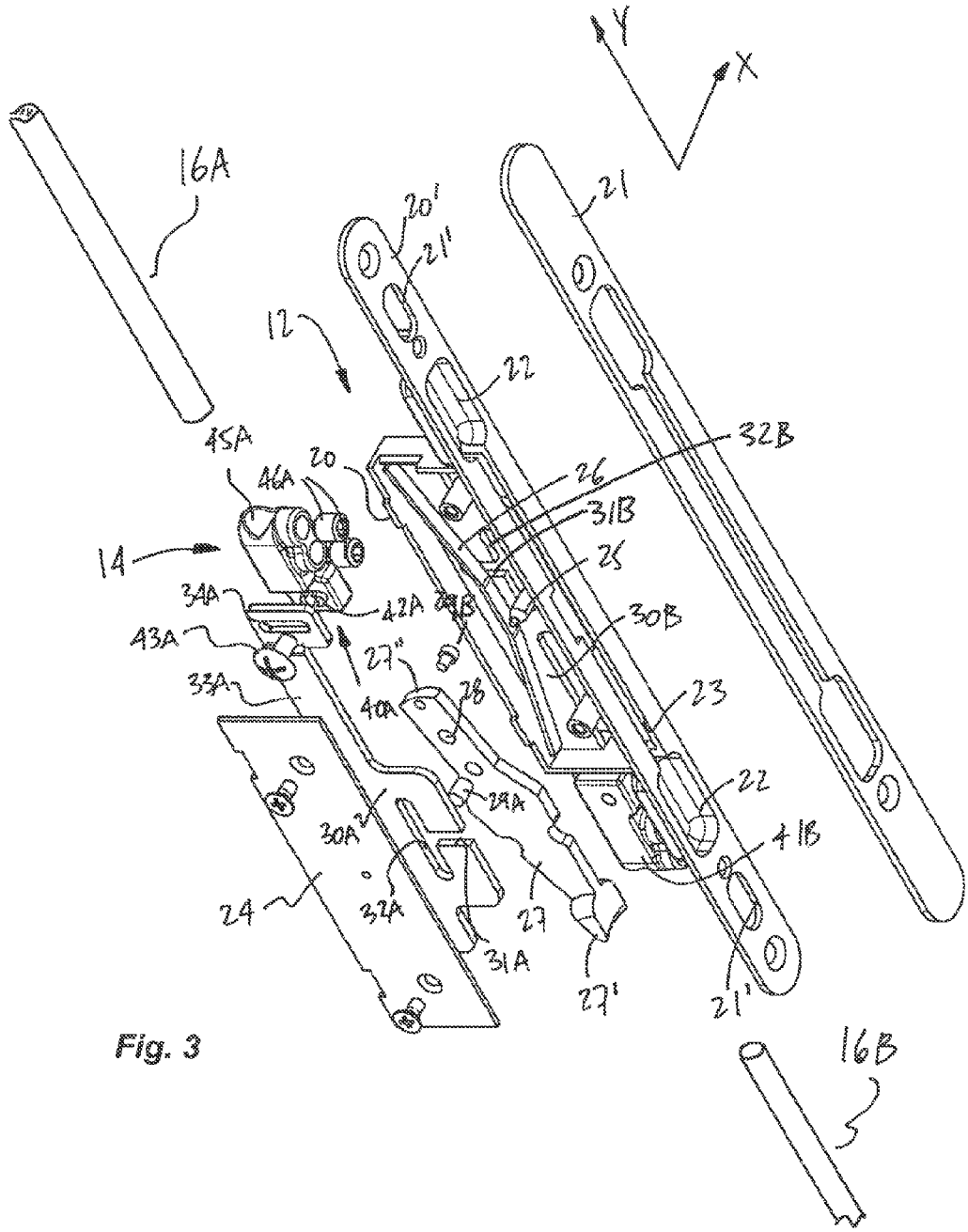
FIG. 3 is an exploded view of a lock mechanism of the lock system of FIG. 2.

Referring concurrently to FIGS. 2 and 3, the lock mechanism 12 is shown in greater detail. The lock mechanism 12 has a given configuration in FIGS. 2 and 3, but any other appropriate configuration may be considered. The lock mechanism 12 may comprise a casing 20 that accommodates various components of the lock mechanism 12. A connection plate 20' is part of the casing 20 and is used to secure the casing 20 to the mortise. A faceplate 21 covers the the connection plate 20' of the casing 20 and is the visible part of the lock mechanism 12 in the astragal B, as observed in FIG. 2. The casing 20 may be screwed or bolted to the astragal B and/or door A (when there is no astragal) via its connection plate 20' to secure the lock system 10 to the door A. Holes 21' are also formed into the connection plate 20' of the casing 20, for accessing the depth adjustment adaptor(s) 14. A pair of cavities 22 are defined in opposite sides of the connection plate 20' and are interrelated by a slot 23, with similar shapes being defined in the faceplate 21. The cavities 22 form bulges at respective ends of the generally straight slot 23. The cavities 22 are sized so as to accommodate a finger of a user of the door.

A removable sideplate 24 is part of the casing 20, and may be removed so as to access an interior of the casing 20. The sideplate 24 is in a plane that is generally perpendicular to a plane of the faceplate 21. A pivot 25 is located in the casing 20. The pivot 25 is positioned between the connection plate 20' and a biasing element 26. The biasing element 26 may be a leaf spring, a plate spring, a coil spring or any appropriate type of spring or biasing element. Lever 27 has a handle 27' and a contact end 27". The lever 27 is pivotally mounted to the pivot 25 by pivot hole 28. Therefore, the lever 27 may be rotated between opposite positions in which the handle 27' is received in either one of the cavities 22, and is therefore generally flush with the lateral surface of the door A or astragal B. When the handle 27' is in either one of the cavities 22, there may be sufficient space for a finger to grasp the handle 27' and to rotate the lever 27 to the opposite position. Moreover, when the handle 27' is in either one of the cavities 22, the elongated body of the lever 27 is within the slot 23.

The contact end 27" abuts against the biasing element 26. When the handle 27' is not in either one of the cavities 22, the biasing element 26 will exert pressure on contact end 27", thereby biasing the handle 27' to return to either one of its positions in the cavities 22.

The movement of the lever 27 is used to displace the rod 16 vertically. As described previously, the lock system 10 may comprise one or two of the rods 16. In FIG. 3, the lock mechanism 12 is illustrated as being capable of displacing a pair of the rods 16. The lever 27 is connected to a set of components per each rod 16, to displace the rod 16, and thus the lock mechanism 12 has a pair of the sets as it drives a pair of the rods 16. In the following paragraphs, a single set of the components will be described, but FIG. 3 will illustrate these components with either an A or a B, with reference numerals affixed with an A representing a first of the sets and reference numbers with a B representing a second of the sets.

A guide pin 29 is mounted to the lever 27, and is in operative contact with a driver 30. The driver 30 comprises a follower slot 31, generally horizontal (i.e., X-axis), and a pivot slot 32, generally vertical (i.e., Y-axis). The guide pin 29 is in the follower slot 31 of the driver 30, whereas the pivot 25 of the casing 20 is in the pivot slot 32. Hence, the pivoting movement of the lever 27 will result in a translation of the driver 30 in a vertical direction, by the guide pin 29 pressing against the perimeter of the follower slot 31. The follower slot 31 is horizontal so as to allow the driver 30 to convert the rotation motion of the guide pin (in its circular path) to a translation, while pivot slot slides along the pivot 25. The driver 30 has an arm 33 projecting out of the casing 20. The arm 33 will therefore move vertically (Y-axis) relative to the casing 20 as a response to a pivoting movement of the lever 27 between opposite positions. An obround slot 34 is defined in a head that is located at an end of the arm 33. The obround slot 34 may be horizontal (X-axis) or quasi-horizontal.

Figure 5:
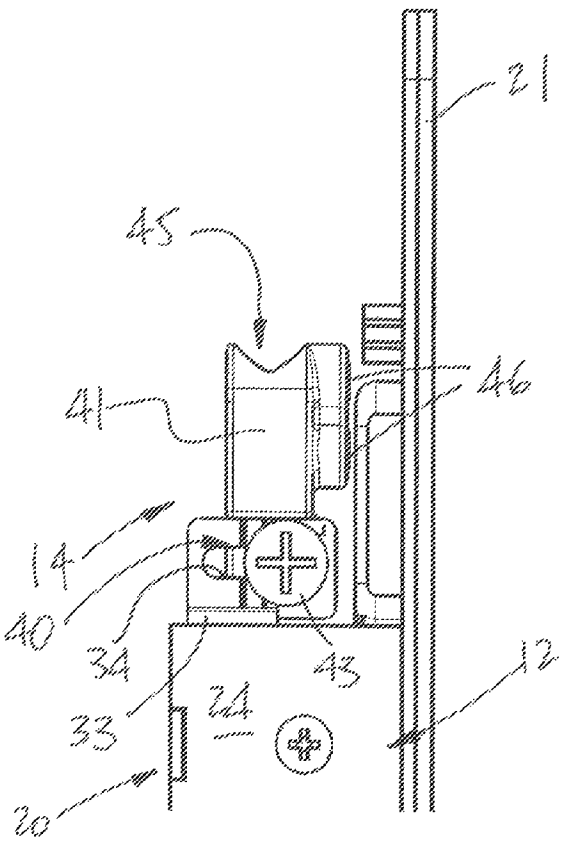
FIG. 5 is an elevation view of the depth adjustment adaptor of the lock mechanism of FIG. 2, in a shallow position.
Figure 4:
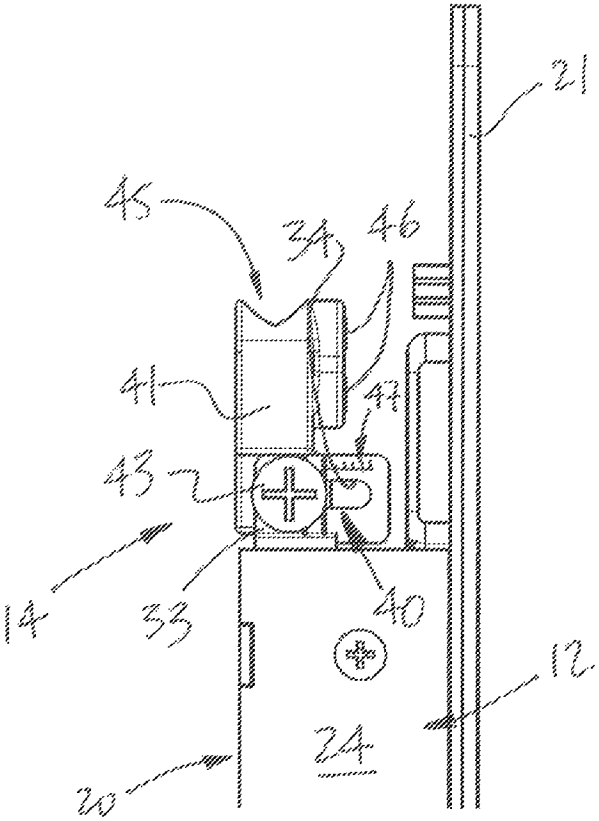
FIG. 4 is a side elevation view of a depth adjustment adaptor of the lock system of FIG. 2 in a deep position.

The depth adjustment adaptor 14 interfaces the rod 16 to the lock mechanism 12. The depth adjustment adaptor 14 may thus be integrally connected to either one of the rod 16 and the driver 30 and releasably connected to the other, or be releasably connected to both the rod 16 and the driver 30. The depth adjustment adaptor 14 allows the adjustment of the lock mechanism 12 to various depths of the mortise C. In accordance with an embodiment, the depth adjustment adaptor 14 has a translational degree of freedom joint 40 (e.g., translation joint, cylindrical joint, prismatic joint, sliding joint). In FIGS. 3-5, the joint 40 consists of a carriage 41 with abutment 42 received in the obround slot 34 of the driver 30. Hence, the carriage 41 may translate in a direction that is horizontal (along the X-axis) or quasi-horizontal, by moving in the obround slot 34. Any other suitable configuration is considered for the translational joint between the locking mechanism 12 and the rod 16. For instance, the abutment 42 could alternatively be part of the arm 33 while the obround slot 34 would be part of the driver 30.

A fastener 43 interrelates the carriage 41 to the obround slot 34 and is received in a tapped hole in the abutment 42, and may be tightened to set a position of the carriage 41 along the obround slot 34, i.e., a depth of the depth adjustment adaptor 14. In other words, the joint 40 is lockable, by fastener 43 or by any other appropriate means. A cavity 45 is defined in the carriage 41 and receives an end of the rod 16. The cavity 45 is therefore a rod interface. One or more set screws 46 may be used to set the rod 16 into engagement with the carriage 41. Other configurations of rod interface are considered as alternatives to the cavity 45. For instance, the rod interface may be a pin received in a cavity of the rod 16, etc. In accordance with another embodiment, the depth adjustment adaptor 14 is similar to that shown in the Figs., but without the translational degree of freedom. In such a case, the depth adjustment adaptor 14 is releasably connectable to both the rod 16 and the driver 30, with a pair of set screws (similar to set screw 46) respectively for the rod 16 and the driver 30. The depth adjustment adaptor 14 is available in different dimensions, for different spacing values between the rod 16 and the driver 30. Hence, instead of keeping an inventory of numerous lock systems 10 for various depths of mortise, the only component kept in inventory of different sizes is the depth adjustment adaptor 14. Hence, a depth adjustment adaptor 14 of specific dimension would be selected as a function of the depth of the mortise. The depth adjustment adaptor 14 without translational joint is a relatively inexpensive piece, whereby a lock system kit could comprise various depth adjustment adaptors 14, for various depths of mortise.

Therefore, during use, when the lock system 10 is in the process of being installed in the mortise C, a position of the rod interface (i.e., carriage 41) is set relative to the driver 30, as a function of the depth of the mortise C, and thus as a function of the distance of the rod 16 from the lateral surface of the door A. For instance, the periphery of the obround slot 34 may be provided with a scale and indicia 47, to guide the installer in setting the position of the depth adjustment adaptor 14 as a function of the depth of the mortise C. In the embodiment of the adaptor 14 without the joint, an adaptor 14 of suitable dimension (as a function of the depth of the mortise) is selected and installed at an end of the rod 16 and at an end of the driver 30.

It is observed that the set screws 46 may be accessed via the holes 21' by a tool (e.g., Allen key, screwdriver, etc) to lock the rod 16 in engagement with the carriage 41. During installation, the rod(s) 16 may be moved away from the depth adjustment adaptor 14 (that has been adjusted as a function of the depth of the mortise C). The rod(s) 16 is then slid into the cavity 45 of the carriage 41. The set screws 46 may then be tightened to lock the rod(s) 16 to the carriage(s) 41.

The lock system 10 may be used with a pair of doors that do not have an astragal therebetween. Moreover, the lock mechanism 12 is provided as an exemplary embodiment, as other mechanisms are considered as well. For instance, any lock mechanism that cause vertical movements of the rod(s) 16 may be considered.

In an embodiment, a flat bar is used as an alternative to the rod 16. The flat bar may be oriented to have its thinner surface parallel to the lateral surface of the door A, with the thinner surface being off-centered. This may allow the astragal B to be screwed to a center of the lateral surface of the door A, thereby increasing a distance of the fasteners from the edges of the door A. In an embodiment with the flat bar, the rod interface (i.e., the bar interface) may be modified to receive the free end of the flat bar.

The invention claimed is:

1. A lock system for a door comprising:

at least one elongated member adapted to axially and vertically translate in the door so as to be moved in and out of engagement with a lock catch of a door frame;

a lock mechanism adapted to be received in a mortise defined in a depth of the door, the depth of the door extending in a direction perpendicular to a vertical direction along which the at least one elongated member translates, the lock mechanism having a handle actuatable to displace at least one driver such that the at least one driver is movable in translation; and a depth adjustment adaptor for said at least one elongated member, the depth adjustment adaptor comprising an interface releasably connected to the at least one elongated member, and a joint with at least one degree of freedom, the joint being connected to the interface and allowing movement of the interface in the direction in which the depth of the door extends to adjust a position of the interface relative to the at least one driver and to a lateral surface of the door, the position of the interface is adjusted by movement of a portion of the interface relative to the at least one driver in the at least one degree of freedom, the depth adjustment adaptor connecting the at least one driver to the at least one elongated member such that actuation of the handle displaces the at least one driver which in turn causes the axial and vertical translation of the at least one elongated member, wherein the interface includes a carriage with a cavity for receiving a free end of the at least one elongated member, the carriage having an abutment slidingly moving within a slot on the at least one driver to form the joint.

2. The lock system according to claim 1, wherein the joint is a lockable sliding joint.

3. The lock system according to claim 1, wherein the at least one degree of freedom of the joint is a translation in the direction in which the depth of the door extends and that is perpendicular to the direction of the translation of the at least one elongated member.

4. The lock system according to claim 1, wherein the joint comprises a scale with indicia indicating a value related to a depth of the at least one elongated member relative to the lateral surface of the door.

5. The lock system according to claim 1, wherein the carriage comprises at least one set screw releasably pressed against the free end of the at least one elongated member in the carriage, a tool end of the at least one set screw being oriented toward the lateral surface of the door.

6. The lock system according to claim 5, wherein the lock mechanism has a faceplate, with a hole being defined in the faceplate to access the at least one set screw.

7. The lock system according to claim 1, further comprising a fastener in screwing engagement with the carriage, a tightening of the fastener blocking movement of the carriage via the joint.

8. The lock system according to claim 1, wherein the at least one driver includes two drivers, and the at least one elongated member includes two elongated members concurrently moving in opposite directions as a result of actuation from the lock mechanism, wherein the depth adjustment adaptor corresponding to each elongated member is between each elongated member and a corresponding one of the drivers.

9. An assembly of a door and lock system comprising:

the door comprising a mortise defined in a depth of the door and open to a lateral surface thereof, and at least one channel vertically extending from the mortise to an end surface of the door, the depth of the door extending in a direction perpendicular to the at least one channel;

the lock system comprising:

at least one elongated member received in the at least one channel of the door and axially and vertically translatable therein to be moved beyond the end surface of the door and in and out of engagement with a lock catch of a door frame;

a lock mechanism received in the mortise of the door and having a handle actuatable to displace at least one driver such that the at least one driver is movable in translation; and a depth adjustment adaptor for said at least one elongated member, the depth adjustment adaptor comprising an interface releasably connected to the at least one elongated member, and a joint with at least one degree of freedom, the joint being connected to the interface and allowing movement of the interface in the direction in which the depth of the door extends to adjust a position of the interface relative to the at least one driver and to the lateral surface of the door, the position of the interface is adjusted by movement of a portion of the interface relative to the at least one driver in the at least one degree of freedom, the depth adjustment adaptor connecting the at least one driver to the at least one elongated member such that actuation of the handle displaces the at least one driver which in turn causes the axial and vertical translation of the at least one elongated member in the channel, wherein the interface includes a carriage with a cavity for receiving a free end of the at least one elongated member, a fastener being in screwing engagement with the carriage, a tightening of the fastener blocking movement of the carriage via the joint.

10. The assembly according to claim 9, wherein the door comprises an astragal, the mortise being defined in the astragal and the door.

11. The assembly according to claim 9, wherein the at least one degree of freedom of joint is a translation in the direction in which the depth of the door extends and that is perpendicular to the at least one channel, wherein the direction in which the depth of the door extends is perpendicular to the axial and vertical translation of the at least one elongated member.

12. The assembly according to claim 9, wherein the joint comprises a scale with indicia indicating a value related to a depth of the at least one elongated member relative to the lateral surface of the door.

13. The assembly according to claim 9, wherein the carriage has an abutment slidingly moving within a slot on the at least one driver to form the joint.

14. The assembly according to claim 9, wherein the carriage comprises at least one set screw releasably pressed against the free end of the at least one elongated member in the carriage, a tool end of the at least one set screw being oriented toward the lateral surface of the door.

15. The assembly according to claim 14, wherein the lock mechanism has a faceplate, with a hole being defined in the faceplate to access the at least one set screw.

16. The assembly according to claim 9, wherein the at least one channel includes two channels the at least one driver includes two drivers, and the at least one elongated member includes two elongated members concurrently moving in opposite directions as a result of actuation from the lock mechanism, wherein the depth adjustment adaptor corresponding to each elongated member is between each elongated member and a corresponding one of the drivers.

17. A lock system for a door comprising:

at least one elongated member adapted to axially and vertically translate in the door so as to be moved in and out of engagement into a lock catch of a door frame;

a lock mechanism adapted to be received in a mortise defined in a depth of the door, the depth of the door extending in a direction perpendicular to a vertical direction along which the at least one elongated member translates, the lock mechanism having a handle actuatable to displace at least one driver such that the at least one driver is movable in translation; and a depth adjustment adaptor for said at least one elongated member, the depth adjustment adaptor comprising an interface releasably connected to the at least one elongated member, and a joint with at least one degree of freedom, the joint being connected to the interface and allowing movement of the interface in the direction in which the depth of the door extends to adjust a position of the interface relative to the at least one driver and to a lateral surface of the door, the position of the interface is adjusted by movement of a portion of the interface relative to the at least one driver in the at least one degree of freedom, the depth adjustment adaptor connecting the at least one driver to the at least one elongated member such that actuation of the handle displaces the at least one driver which in turn causes the axial and vertical translation of the at least one elongated member, wherein the interface comprises a carriage with a cavity for receiving a free end of the at least one elongated member, the carriage including at least one set screw releasably pressed against the free end of the at least one elongated member in the carriage, a tool end of the at least one set screw being oriented toward the lateral surface of the door.

18. The lock system according to claim 17, wherein the lock mechanism has a faceplate, with a hole being defined in the faceplate to access the at least one set screw.

19. The lock system according to claim 17, wherein the at least one degree of freedom of the joint is a translation in the direction in which the depth of the door extends and that is perpendicular to the direction of the translation of the at least one elongated member.

20. The lock system according to claim 17, wherein the at least one driver comprises two drivers, and the at least one elongated member comprises two elongated members concurrently moving in opposite directions as a result of actuation from the lock mechanism, wherein the depth adjustment adaptor corresponding to each elongated member is between each elongated member and a corresponding one of the drivers.

* * * * *